US011318765B2

(12) United States Patent
Murayama

(10) Patent No.: US 11,318,765 B2
(45) Date of Patent: May 3, 2022

(54) CARRIAGE MOVING MECHANISM AND LIQUID DISCHARGE APPARATUS

(71) Applicant: SEIKO EPSON CORPORATION, Tokyo (JP)

(72) Inventor: Osamu Murayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 539 days.

(21) Appl. No.: 16/202,772

(22) Filed: Nov. 28, 2018

(65) Prior Publication Data

US 2019/0160837 A1 May 30, 2019

(30) Foreign Application Priority Data

Nov. 29, 2017 (JP) ..... JP2017-228723

(51) Int. Cl.

| | |
|---|---|
| ***B41J 19/20*** | (2006.01) |
| ***B41J 2/21*** | (2006.01) |
| ***B41J 19/00*** | (2006.01) |

(52) U.S. Cl.

CPC ..... *B41J 19/005* (2013.01); *B41J 2/2103* (2013.01); *B41J 19/202* (2013.01); *B41J 2/2114* (2013.01)

(58) Field of Classification Search

None

See application file for complete search history.

(56) References Cited

U.S. PATENT DOCUMENTS

| | | | | |
|---|---|---|---|---|
| 5,688,057 | A | 11/1997 | Wright et al. | |
| 5,870,117 | A * | 2/1999 | Moore | B41J 25/005 347/37 |
| 7,247,109 | B2 * | 7/2007 | Youn | B41J 19/005 474/109 |
| 2007/0201930 | A1 * | 8/2007 | Sugiura | B41J 19/20 400/354 |
| 2008/0204536 | A1 | 8/2008 | Suzuki | |
| 2009/0174749 | A1 | 7/2009 | Kemma | |
| 2011/0103870 | A1 | 5/2011 | Ikeda et al. | |

FOREIGN PATENT DOCUMENTS

| | | |
|---|---|---|
| EP | 1958784 | 8/2008 |
| JP | S61-295061 | 12/1986 |
| JP | 2002-254718 A | 9/2002 |
| JP | 2015-150749 A | 8/2015 |

* cited by examiner

*Primary Examiner* — Jill E Culler

(74) *Attorney, Agent, or Firm* — Workman Nydegger

(57) ABSTRACT

A carriage moving mechanism including a driving unit including a driving pulley, a driving motor, and a first support member for supporting both the driving pulley and the driving motor, a driven unit including a driven pulley and a second support member for supporting the driven pulley, and a third support member supporting both the driving unit and the driven unit, an annular belt that is wound around both the driving pulley and the driven pulley, a first outer peripheral surface and a second outer peripheral surface facing to the first outer peripheral surface, and a first carriage that is attached to the first outer peripheral surface, wherein the second support member, the third support member, and the first support member are aligned in this order in a first axis, and the third support member is disposed inside the annular belt.

10 Claims, 11 Drawing Sheets

CARRIAGE MOVING MECHANISM AND LIQUID DISCHARGE APPARATUS

BACKGROUND

1. Technical Field

The invention relates to a carriage moving mechanism and a liquid discharge apparatus having the carriage moving mechanism.

2. Related Art

For example, a printer (a liquid discharge apparatus) described in JP-A-2015-150749 includes a carriage on which a recording head is loaded, a driving pulley and a driven pulley, a driving motor for supporting and driving the driving pulley, a support member for rotatably supporting the driven pulley, a belt that is wound around both the driving pulley and the driven pulley, a biasing member for providing a predefined tension (a tensional force) to the belt, and a frame for supporting both the driving motor and the support member. A driving pulley (a driving motor) is attached to one end of the frame, a driven pulley (a support member) is attached to the other end of the frame, and the driving pulley and the driven pulley are disposed on a surface at one side of the frame. The frame supports the driving pulley and the driven pulley around which the belt is wound such that a predefined tension is applied to the belt.

According to the liquid discharge apparatus described in JP-A-2015-150749, when a predefined tension is applied to the belt, the tension applied to the belt acts on both one end of the frame to which the driving pulley is attached and the other end of the frame to which the driven pulley is attached. A portion of the frame that supports the driving pulley and a portion of the frame that supports the driven pulley serve as points of action on which the tension acts. A portion to which the frame is fixed (e.g., a portion where the frame is fixed to a casing) serves as a fulcrum for supporting the force that acts on the point of action. Then, a force (a moment) to rotate the points of action of the frame around the fulcrum of the frame acts on the frame.

However, when the liquid discharge apparatus is made large in size and the frame is made long in length, the distance between the point of action of the frame and the fulcrum of the frame is longer, and the moment that acts on the frame are enlarged, and thus the frame may be deformed.

SUMMARY

The invention is made to address at least some of the above-described issues, and can be achieved the embodiments or the application examples described below.

Application Example 1

A carriage moving mechanism according to Application Example 1 includes a driving unit including a driving pulley, a driving motor, and a first support member for supporting the driving pulley and the driving motor, a driven unit including a driven pulley and a second support member for supporting the driven pulley, a third support member that is disposed from the first support member to the second support member, and supports the driving unit and the driven unit, an annular belt that is wound around the driving pulley and the driven pulley, and has, between the driving pulley and the driven pulley, a first outer peripheral surface and a second outer peripheral surface facing to the first outer peripheral surface, and a first carriage that is attached to the first outer peripheral surface, wherein the second support member, the third support member, and the first support member are aligned in this order in a first axis, the second outer peripheral surface and the first outer peripheral surface are aligned in a second axis intersecting with the first axis, and the third support member is disposed inside the annular belt.

The first support member is a member for supporting the driving pulley. The second support member is a member for supporting the driven pulley. The third support member, which is a member for supporting the first support member (the driving pulley) and the second support member (the driven pulley), is equivalent of the frame in the related art. A predefined tension needs to be applied to the annular belt making the annular belt in a tensioned state between the driving pulley and the driven pulley, so that the first carriage (the annular belt) may be properly moved. The third support member supports the driving pulley and the driven pulley around which the annular belt is wound such that a predefined tension is applied to the annular belt. In this case, the tension applied to the annular belt acts on the portion that supports the driving pulley of the third support member and the portion that supports the driven pulley of the third support member.

The deformation in an axis from the second support member to the first support member in the third support member, that is, the deformation in the first axis (a compressive deformation, a tensile deformation, and the like) in the third support member, needs to be prevented, so that the third support member may properly support the first support member and the second support member. Thus, the third support member composed of a member (e.g., a member having rigidity) that is hardly deformed in the first axis prevents a deformation in the first axis. However, when the distance between the second support member and the first support member is made long and the dimension in the first axis of the third support member is made large, the third support member is readily deformed in the second axis. That is, a bending deformation and the like readily occurs in the third support member.

When the second support member, the third support member, and the first support member are aligned in this order in the first axis and then the third support member is disposed inside the annular belt, the portion that supports the driving pulley in the third support member, the portion to which the third support member is fixed, and the portion that supports the driven pulley in the third support member can be aligned in the first axis. Then, a force (a moment) causing the portion that supports the driving pulley in the third support member and the portion that supports the driven pulley in the third support member in the second axis to be deformed using the portion to which the third support member is fixed as a fulcrum, no longer acts.

Thus, even in a case that the distance between the second support member and the first support member is made long and the dimension in the first axis of the third support member is made large, the third support member may be prevented from being deformed (a bending deformation) in the second axis.

Application Example 2

A carriage moving mechanism according to Application Example 2 includes a driving unit including a driving pulley, a driving motor, and a first support member for supporting the driving pulley and the driving motor, a driven unit including a driven pulley and a second support member for supporting the driven pulley, a third support member that is disposed from the first support member to the second support member, and supports the driving unit and the driven unit, an annular belt that is wound around the driving pulley and the driven pulley, and has, between the driving pulley and the driven pulley, a first outer peripheral and a second outer peripheral surface facing to the first outer peripheral surface, and a first carriage that is attached to the first outer peripheral surface, wherein when a division plane is defined as a plane to equally divide the annular belt and when the division plane faces to the first outer peripheral surface and the second outer peripheral surface, the second support member, the third support member, and the first support member are aligned in this order in a first axis, the second outer peripheral surface and the first outer peripheral surface are aligned in the second axis that intersects with the first axis, and in a plan view from the first axis, a portion where the annular belt intersects the division plane overlaps with the third support member.

The portion where the annular belt intersects with the division plane serves as the portion on which the tension acts in the annular belt. When a portion where the annular belt intersects with the division plane overlaps with the third support member in a plan view from the first axis, the portion on which the tension acts in the annular belt, the portion that supports the driving pulley in the third support member, the portion to which the third support member is fixed, and the portion that supports the driven pulley in the third support member can be aligned in the first axis. Then, a force (a moment) causing the portion that supports the driving pulley in the third support member and the portion that supports the driven pulley in the third support member in the second axis to be deformed using the portion to which the third support member is fixed as a fulcrum, no longer acts.

Thus, even in a case that the distance between the second support member and the first support member is made long and the dimension in the first axis of the third support member is made large, the third support member may be prevented from being deformed (a bending deformation) in the second axis.

Application Example 3

In the carriage moving mechanism according to the above application examples, a second carriage may be attached to the second outer peripheral surface.

According to the configuration in which the first carriage is attached to the first outer peripheral surface, a first object loaded on the first carriage can be moved together with the first carriage. According to the configuration in which the first carriage is attached to the first outer peripheral surface and the second carriage is attached to the second outer peripheral surface, the first object loaded on the first carriage and a second object loaded on the second carriage can be moved together with the first carriage and the second carriage.

Thus, according to the configuration in which the first carriage is attached to the first outer peripheral surface and the second carriage is attached to the second outer peripheral surface, the number of movable object can be increased compared to the configuration in which only the first carriage is attached to the first outer peripheral surface.

Application Example 4

A liquid discharge apparatus according to Application Example 4 includes the carriage moving mechanism according to the above application examples, and a first liquid discharge head that is attached to the first carriage, and discharges a first liquid onto a medium.

The carriage moving mechanism according to the above application examples can move the first carriage in the first axis by causing the annular belt wound around the driving pulley and the driven pulley to rotate. A liquid discharge apparatus including the carriage moving mechanism can form an image on a medium by discharging the first liquid onto the medium while causing the first liquid discharge head to move together with the first carriage in the first axis.

When the third support member is made deformed, the positions of the driving pulley and the driven pulley change, and a deformation (e.g., a deflection) of the annular belt occurs, and it becomes hard to cause the first carriage to move properly in the first axis. Then, it becomes hard for the liquid discharge apparatus to cause the first liquid discharge head to move properly in the first axis, and quality of the image to be printed on the medium M may degrade.

In Application Example 4, since the third support member is suppressed from being deformed, it is hard for the positions of the driving pulley and the driven pulley to change and it is hard for the annular belt to be deformed, the first carriage and the first liquid discharge head can be properly moved in the first axis. Thus, the first liquid discharge head can be properly moved in the first axis, and quality of the image formed on the medium can be prevented from degrading.

Application Example 5

A liquid discharge apparatus according to Application Example 5 includes the carriage moving mechanism according to Application Example 3, a first liquid discharge head that is attached to the first carriage, and discharges a first liquid onto a medium, and a second liquid discharge head that is attached to the second carriage, and discharges the first liquid or a second liquid onto the medium.

For example, compared with a configuration in which the first liquid is discharged only from the first liquid discharge head, in a configuration in which the first liquid is discharged from the first liquid discharge head and the second liquid discharge head, an area to which the first liquid is discharged is made wider, and thus the productivity of the liquid discharge apparatus can be enhanced.

For example, compared with the configuration in which the first liquid is discharged only from the first liquid discharge head, a variety of processing can be executed with a configuration in which the first liquid is discharged from the first liquid discharge head and the second liquid is discharged from the second liquid discharge head.

Application Example 6

A liquid discharge apparatus according to Application Example 6 includes the carriage moving mechanism according to Application Example 3, a liquid discharge head that is attached to the first carriage, and discharges a first liquid onto a medium, and an irradiation device irradiating the medium with light or an ionizer neutralizing the medium, that is attached to the second carriage.

For example, in a configuration in which the first liquid discharge head is attached to the first carriage and the ionizer is attached to the second carriage, an adverse effect of static electricity can be suppressed in such a way that the first liquid is discharged onto the medium that has been neutralized by the ionizer to form an image.

For example, in a configuration in which the first liquid discharge head is attached to the first carriage and the irradiation device is attached to the second carriage, a photocurable ink discharged onto the medium can be suppressed from spreading (bleeding) in such a way that the photocurable ink as the first liquid discharged from the first liquid discharge head onto the medium is cured by the irradiation device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention are described below with reference to the accompanying drawings. The exemplary embodiments illustrate some aspects of the invention, and do not limit the invention in any way. The exemplary embodiments can be modified as desired without departing from the scope of the technical concept of the invention. Further, in each of the drawings below, to make each layer, member, and the like recognizable in terms of size, each of the layers, members, and the like is illustrated to be different to an actual scale.

Exemplary Embodiment 1

Overview of Printer

Figure 1:
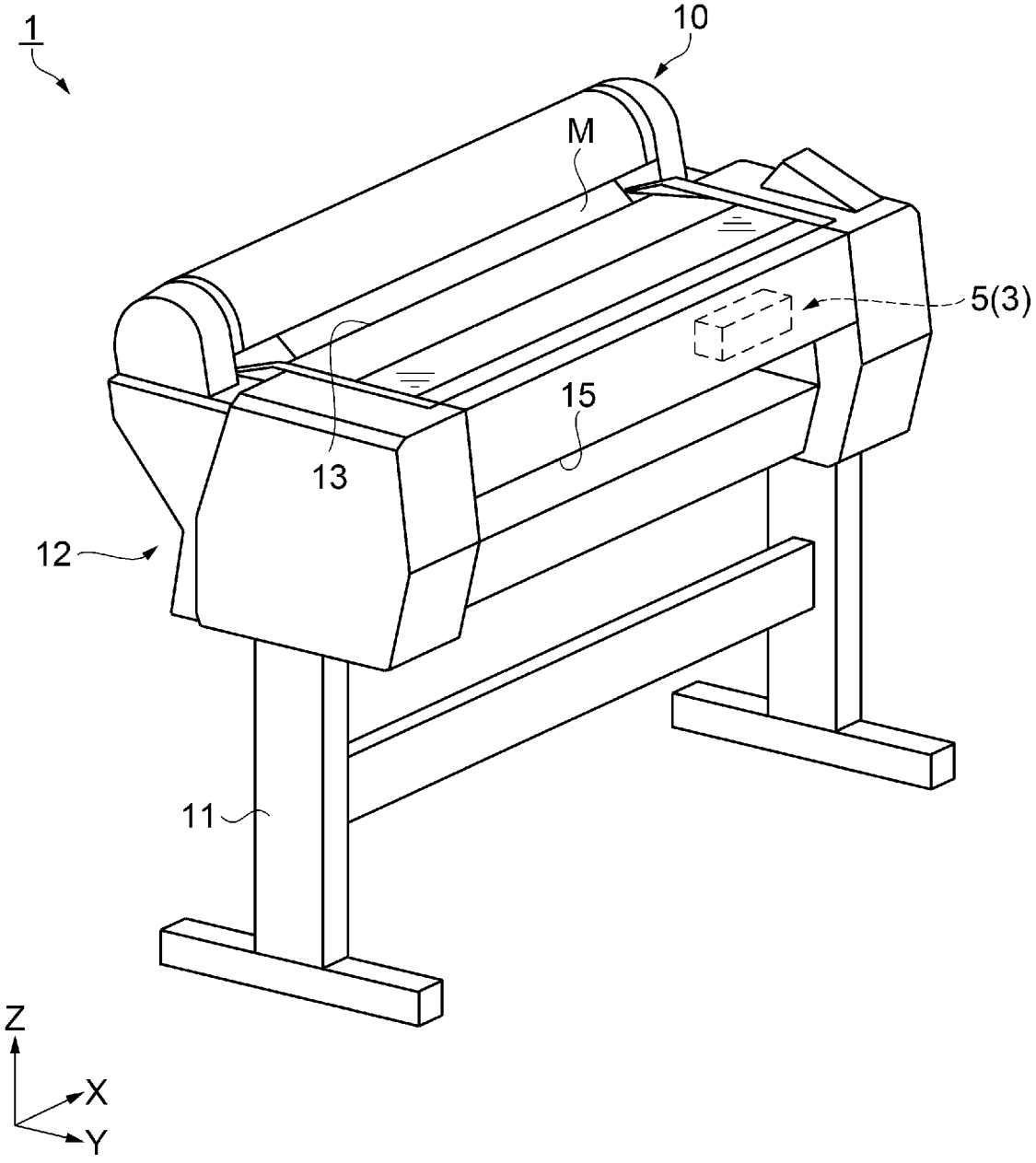
FIG. 1 is a perspective view of a printer according to Exemplary Embodiment 1.

FIG. 1 is a perspective view of a printer according to Exemplary Embodiment 1.

First of all, an overview of the printer 1 according to Exemplary Embodiment 1 is described below with reference to FIG. 1.

As illustrated in FIG. 1, the printer 1 according to Exemplary Embodiment 1, which is an example of the "liquid discharge apparatus", is a large-format printer (LFP) that prints images on, for example, a single-cut sheet having a large sheet size such as A1-sized sheet of JIS standard, a roll paper having the same width as the single-cut sheet, and the like.

The printer 1 includes a pair of leg portions 11, a casing portion 12 substantially formed in a rectangular parallelepiped shape supported by the leg portion 11, a setting portion 10 for feeding a medium M to the casing portion 12, and a carriage moving mechanism 3 described below (see FIG. 2). For example, cloth such as polyester, paper, resin film, and the like can be used for the medium M.

In the descriptions below, a longitudinal axis of the casing portion 12 is defined as an X axis and a lateral axis of the casing portion 12 is defined as a Y axis. A height axis of the casing portion 12 intersecting with the X axis and the Y axis is defined as a Z axis. In addition, a leading-end side of an arrow indicating the axis is defined as a (+) axis and a base-end side of the arrow is defined as a (−) axis.

Note that the X axis is an example of a "first axis". The Y axis is an example of a "second axis". Also note that the Z axis (the Z (+) axis) is an opposite axis to the axis of gravitational force.

The setting portion 10 stores a roll body (not illustrated) around which the medium M is wound in a cylindrical shape (a roll shape) and a roll-drive mechanism (not illustrated) for driving the roll body. The medium M is fed out from the roll body being rotated by the roll-drive mechanism to be supplied to a recording head 5 inside the casing portion 12.

The recording head 5, which is an example of the "first liquid discharge head", is loaded on the carriage moving mechanism 3.

The casing portion 12 has a supply port 13, an exhaust port 15, and the like. The supply port 13 is provided at an upper back surface of the casing portion 12. The medium M fed out from the roll body stored in the setting portion 10 is supplied into an inner portion of the casing portion 12 through the supply port 13. The exhaust port 15 is provided on a front surface of the casing portion 12. The medium M on which an image has been printed in the casing portion 12 is fed out through the exhaust port 15 to an outer portion of the casing portion 12.

Overview of Carriage Moving Mechanism

Figure 2:
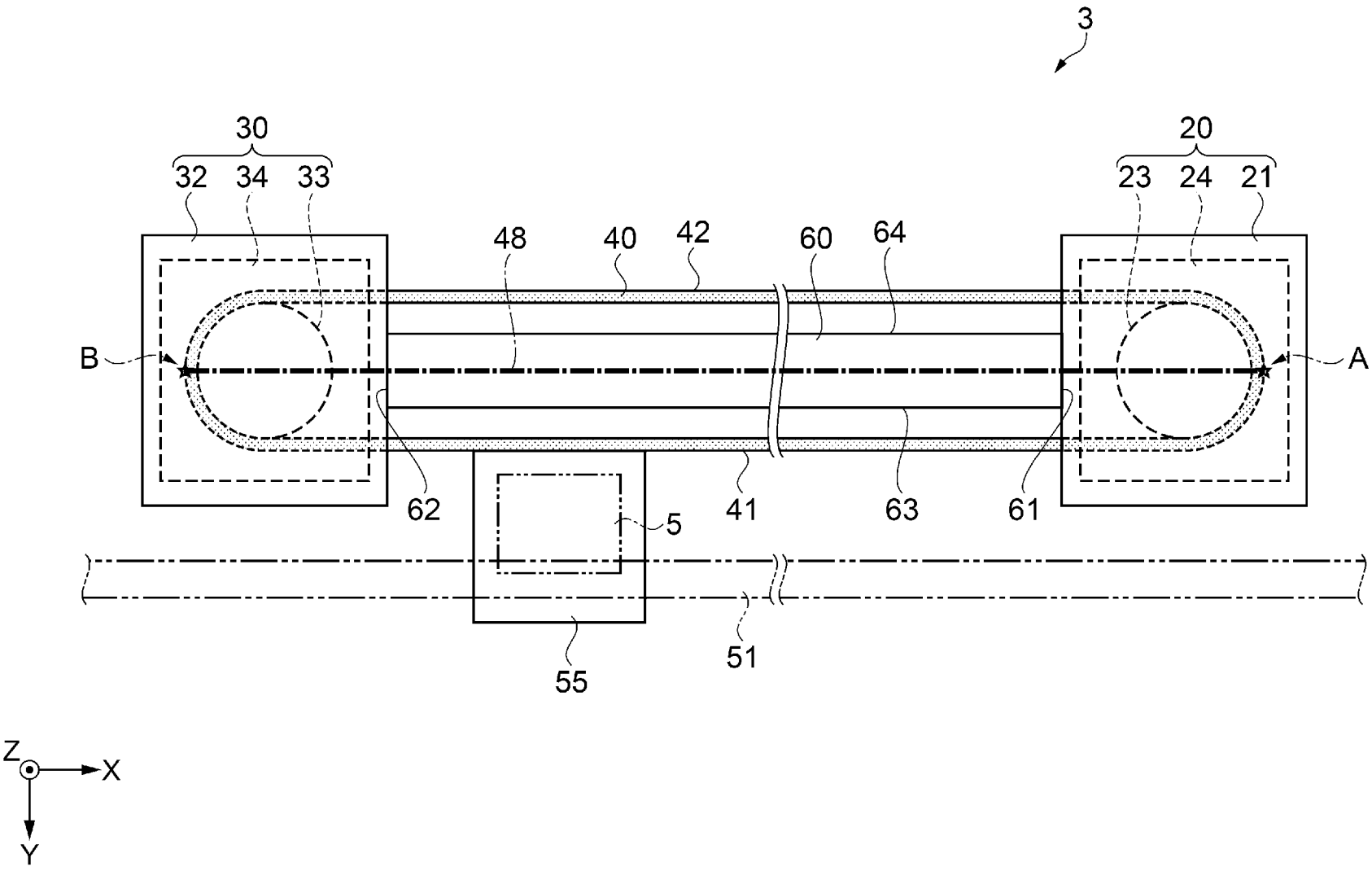
FIG. 2 is a schematic view illustrating the configuration of a carriage moving mechanism according to Exemplary Embodiment 1.
Figure 3:
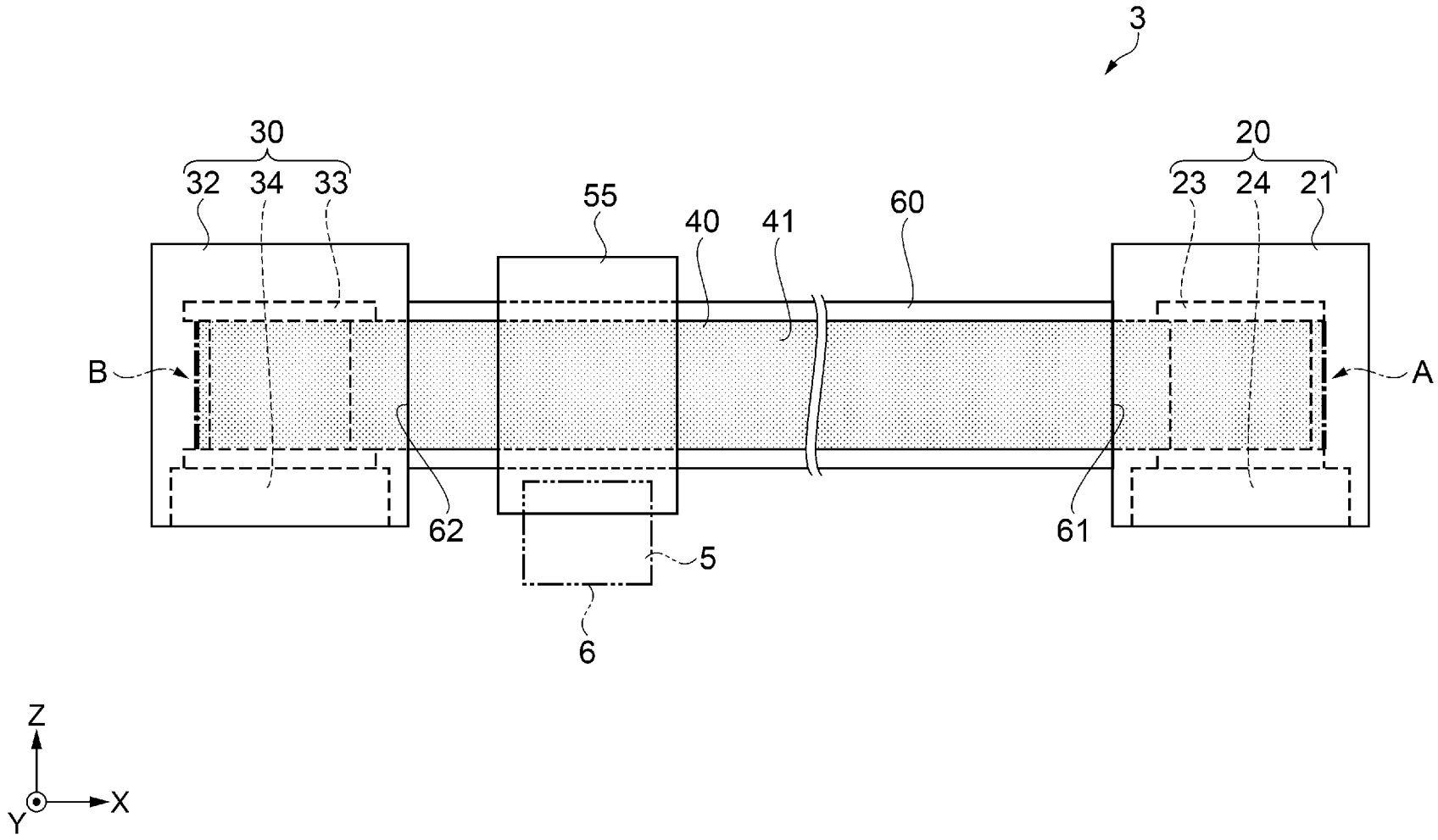
FIG. 3 is a schematic view illustrating the configuration of the carriage moving mechanism according to Exemplary Embodiment 1.
Figure 4:
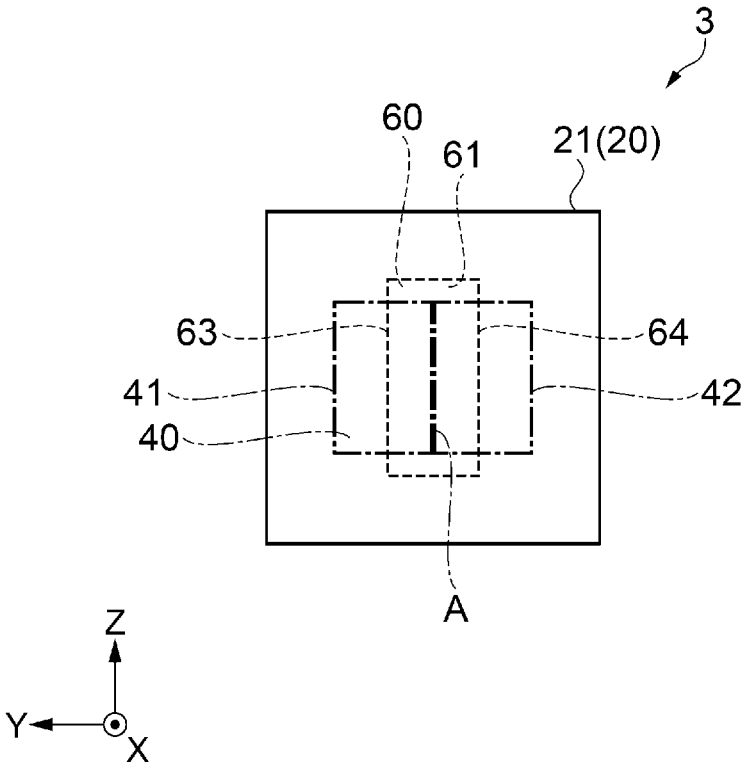
FIG. 4 is a schematic view illustrating the configuration of the carriage moving mechanism according to Exemplary Embodiment 1.
Figure 5:
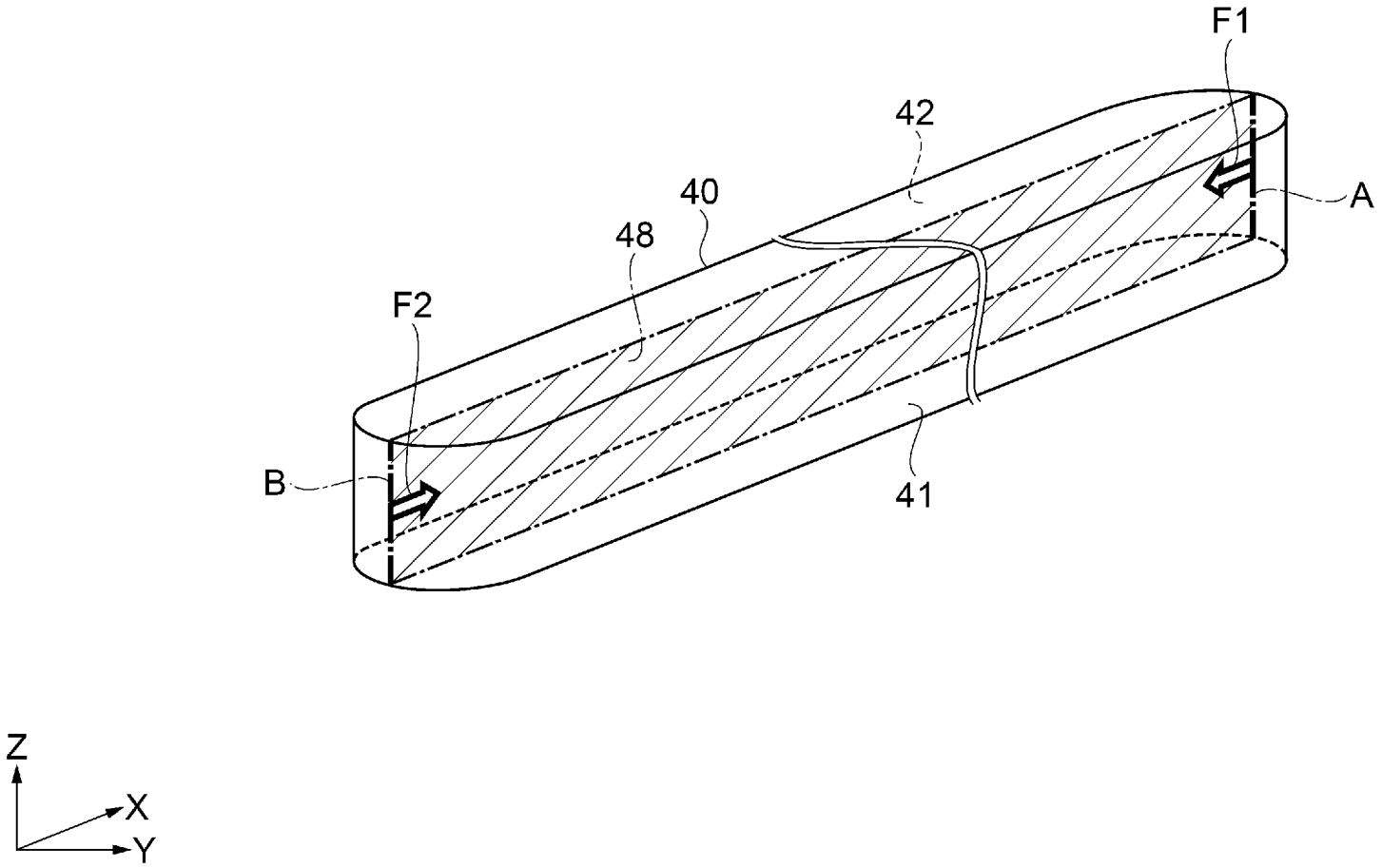
FIG. 5 is a perspective view schematically illustrating a status of an annular belt.

FIG. 2 to FIG. 4 are schematic views illustrating the configuration of the carriage moving mechanism according to Exemplary Embodiment 1. FIG. 5 is a perspective view schematically illustrating a status of the annular belt.

More specifically, FIG. 2 is a plan view of the carriage moving mechanism 3 from a Z axis side. FIG. 3 is a plan view of the carriage moving mechanism 3 from a Y axis side. FIG. 4 is a plan view of the carriage moving mechanism 3 from an X axis side.

FIG. 2 and FIG. 3 indicate the components of the carriage moving mechanism 3 by solid lines or broken lines. In addition, FIG. 2 and FIG. 3 indicate components (the recording head 5 and a guide shaft 51) by two-dot chain lines, excluding the components of the carriage moving mechanism 3.

Among the components of the carriage moving mechanism 3 that are illustrated in FIG. 4, a first support member 21 is indicated by a solid line, a third support member 60 is indicated by a broken line, and an annular belt 40 is indicated by a chain line, omitting the illustration of the other components.

Next, an overview of the carriage moving mechanism 3 is described below with reference to FIG. 2 to FIG. 5.

As illustrated in FIG. 2 and FIG. 3, the carriage moving mechanism 3 has a driving unit 20 disposed on an X (+) axis side, a driven unit 30 disposed on an X (−) axis side, the third support member 60 for supporting the driving unit 20 and the driven unit 30, the annular belt 40 wound around a driving pulley 23 of the driving unit 20 and a driven pulley 33 of the driven unit 30, and a carriage 55 attached to the annular belt 40.

Note that the carriage 55 is an example of a "first carriage".

The driving unit 20 has the driving pulley 23, a driving motor 24, and a first support member 21 for supporting the driving pulley 23 and the driving motor 24. That is, the driving pulley 23 and the driving motor 24 are disposed inside the first support member 21.

The driving pulley 23 is coupled to the driving motor 24 and is supported by the first support member 21 via the driving motor 24. The first support member 21, which is made of metal for example, has rigidity to avoid deformation when supporting the driving pulley 23 and the driving motor 24. The driving motor 24 is, for example, a DC motor. When the driving motor 24 is driven, a torque is transmitted to the driving pulley 23 and the driving pulley 23 rotates.

The driven unit 30 has the driven pulley 33, a base portion 34, and a second support member 32 for supporting the driven pulley 33 and the base portion 34. The driven pulley 33 is rotatably coupled to the base portion 34 and is supported by the second support member 32 via the base portion 34. The second support member 32, which is made of metal for example, has rigidity to avoid deformation when supporting the driven pulley 33 and the base portion 34. The driven pulley 33 is movable with respect to the second support member 32 and the position of the driven pulley 33 can be adjusted by causing the base portion 34 to move.

The third support member 60 is disposed from the first support member 21 to the second support member 32 and is fixed to the casing portion 12. Specifically, the second support member 32, the third support member 60, and the first support member 21 are aligned in this order in the X axis. The third support member 60 is fixed to the casing portion 12. The third support member 60 supports the driving unit 20 (the first support member 21) and the driven unit 30 (the second support member 32). The third support member 60, which is made of metal for example, has rigidity to avoid deformation when supporting the driving unit 20 and the driven unit 30. The third support member 60 has a surface 61 disposed on the X (+) axis side, a surface 62 disposed on the X (−) axis side, a surface 63 disposed on a Y (+) axis side, and a surface 64 disposed on a Y (−) axis side. The surface 61 of the third support member 60 is in contact with the first support member 21. The surface 62 of the third support member 60 is in contact the second support member 32.

The surfaces 63 and 64 of the third support member 60 are disposed, in a plan view from the Z axis side, between a first outer peripheral surface 41 of the annular belt 40 and a second outer peripheral surface 42 of the annular belt (see FIG. 2). In other words, the surfaces 63 and 64 of the third support member 60 are disposed inside the annular belt 40.

The surfaces 61 and 62 of the third support member 60 are disposed, in a plan view from the Y axis side, between an end on the X (+) axis side (a portion A described below) of the annular belt 40 and an end on the X (−) axis side (a portion B described below) (see FIG. 3). In other words, the surfaces 61 and 62 of the third support member 60 are disposed inside the annular belt 40.

The status that the "third support member is disposed inside the annular belt" includes as an example, the status that the surfaces 63 and 64 of the third support member 60 are disposed between the first outer peripheral surface 41 of the annular belt 40 and the second outer peripheral surface 42 of the annular belt 40, and the surfaces 61 and 62 of the third support member 60 are disposed between the end on the X (+) axis side (the portion A) of the annular belt 40 and the end on the X (−) axis side (the portion B) of the annular belt 40.

As illustrated in FIG. 4, the end on the X (+) axis side (the portion A) of the annular belt 40 is disposed to overlap, in a plan view from the X axis side, with the surface 61 of the third support member 60, when the surfaces 63 and 64 of the third support member 60 are disposed between the first outer peripheral surface 41 of the annular belt 40 and the second outer peripheral surface 42 of the annular belt 40, and the surfaces 61 and 62 of the third support member 60 are disposed between the end on the X (+) axis side (the portion A) of the annular belt 40 and the end on the X (−) axis side (the portion B) of the annular belt 40, in other words, when the third support member 60 is disposed inside the annular belt 40.

Although not illustrated in FIG. 4, the first support member 21 has the same shape, in a plan view from the X axis side, as the second support member 32, and overlaps with the second support member 32. The end on the X (−) axis side (the portion B; see FIG. 3) of the annular belt 40 is disposed to overlap, in a plan view from the X axis side, with the surface 62 (see FIG. 3) of the third support member 60 in the same manner as the end on the X (+) axis side (the portion A) of the annular belt 40.

The status that the "portion where the annular belt intersects with the division plane overlaps, in a plan view from the first axis side, with the third support member" includes, as an example the status that, in a plan view from the X axis side, the end on the X (+) axis side (the portion A) of the annular belt 40 is disposed to overlap with the surface 61 of the third support member 60, and the end on the X (−) axis side (the portion B; see FIG. 3) of the annular belt 40 is disposed to overlap with the surface 62 of the third support member 60.

As described above, Exemplary Embodiment 1 includes both the configuration in the present application that the "third support member is disposed inside the annular belt" and the configuration in the present application that the "in a plan view from the first axis, a portion where the annular belt intersects with the division plane overlaps with the third support member".

The annular belt 40 is an endless belt and is wound around the driving pulley 23 and the driven pulley 33 in a state of being applied with a predefined tension. The tension applied to the annular belt 40 can be adjusted by moving the base portion 34 so as to cause the position of the driven pulley 33 to change. That is, the position of the driven pulley 33 is adjusted such that a predefined tension is applied to the annular belt 40.

When the driving motor 24 is driven to rotate the driving pulley 23, the annular belt 40 rotates following the rotation of the driving pulley 23. The driven pulley 33 is driven to be rotated, following the rotation of the annular belt 40.

A part (an end portion) of the annular belt 40 is disposed inside both of the first support member 21 and the second support member 32. The annular belt 40 includes a portion disposed inside the first support member 21 indicated by a broken line in the drawing, a portion disposed inside the second support member 32 indicated by a broken line in the drawing, and a portion disposed between the first support member 21 and the second support member 32 indicated by solid lines in the drawing.

The annular belt 40 has the first outer peripheral surface 41 disposed on the Y (+) axis side, and the second outer peripheral surface 42 disposed on the Y (−) axis side in a manner being opposite to the first outer peripheral surface 41. The first outer peripheral surface 41 and the second outer peripheral surface 42 are outer peripheral surfaces of a portion disposed between the first support member 21 and the second support member 32 in the annular belt 40. For example, when the annular belt 40 rotates, in the portion disposed between the first support member 21 and the second support member 32 of the annular belt 40, the outer peripheral surface disposed on the Y (+) axis side is the first outer peripheral surface 41 and the outer peripheral surface disposed on the Y (−) axis side is the second outer peripheral surface 42. The first outer peripheral surface 41 and the second outer peripheral surface 42 are sequentially aligned in the Y axis.

The carriage 55 is attached to the first outer peripheral surface 41 of the annular belt 40. Further, the carriage 55 is supported by the guide shaft 51. The guide shaft 51 indicated by a two-dot chain line in the drawing is supported, extending in the X axis, by the casing portion 12 (see FIG. 1). The guide shaft 51 is a member for guiding the movement of the carriage 55. That is, the guide shaft 51 moves in the X (+) axis or in the X (−) axis between the first support member 21 and the second support member 32, with the movement axis of the carriage 55 being guided by the guide shaft 51.

The recording head 5 discharging an ink as an example of the "first liquid", is attached to the surface on the Z (−) axis side of the carriage 55. The recording head 5 moves in the X (+) axis or in the X (−) axis together with the carriage 55 between the first support member 21 and the second support member 32. The recording head 5 is attached to the surface on the Z (−) axis side of the carriage 55, and includes on the Z (-) axis side a nozzle forming surface 6 provided with a nozzle (not illustrated) that discharges an ink.

The ink discharged by the recording head 5 is a color ink containing colored pigments or dyes such as cyan (C), magenta (M), yellow (Y), and black (K).

According to the configuration, the printer 1 repeats an operation of moving the recording head 5 in the X (+) axis or in the X (−) axis while the recording head 5 is discharging an ink onto the medium M and an operation of transporting the medium M in the Y axis, and thus a desired image is printed on the medium M.

FIG. 5 illustrates, in addition to the annular belt 40, a division plane 48 that equally divides the annular belt 40. The division plane 48 is an imaginary plane that equally divides the annular belt 40. The division plane 48, which is an XZ plane, is disposed opposite to the first outer peripheral surface 41 and the second outer peripheral surface 42 to equally divide the annular belt 40. In other words, the division plane 48 is defined a plane to equally divide the annular belt 40. Further, the division plane 48 faces to the first outer peripheral surface 41 and the second outer peripheral surface 42. That is, the XZ plane located equidistant from the first outer peripheral surface 41 and the second outer peripheral surface 42 is the division plane 48. In addition, a portion where the annular belt 40 intersects with the division plane 48 is indicated by a thick broken line.

As illustrated in FIG. 5, the annular belt 40 has a portion A intersecting with the division plane 48 disposed on the X (+) axis side and a portion B intersecting with the division plane 48 disposed on the X (−) axis side. The portion A is an end on the X (+) axis side of the annular belt 40, and the portion B is an end on the X (−) axis side of the annular belt 40.

Note that the portion A and the portion B are examples of the "portion where the annular belt intersects with the division plane".

Figure 7:
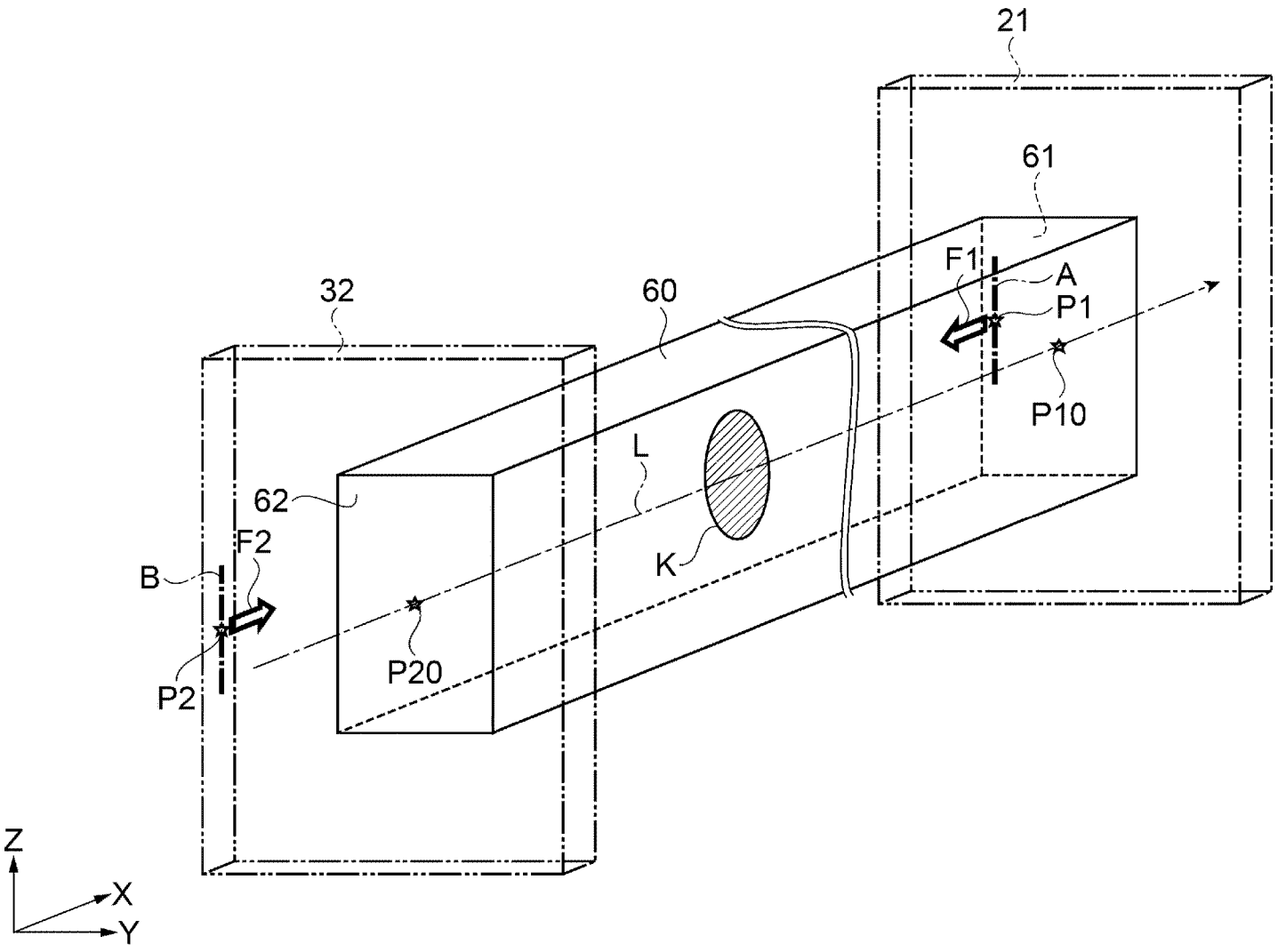
FIG. 7 is a schematic view illustrating a status of the third support member according to a comparative example.
Figure 8:
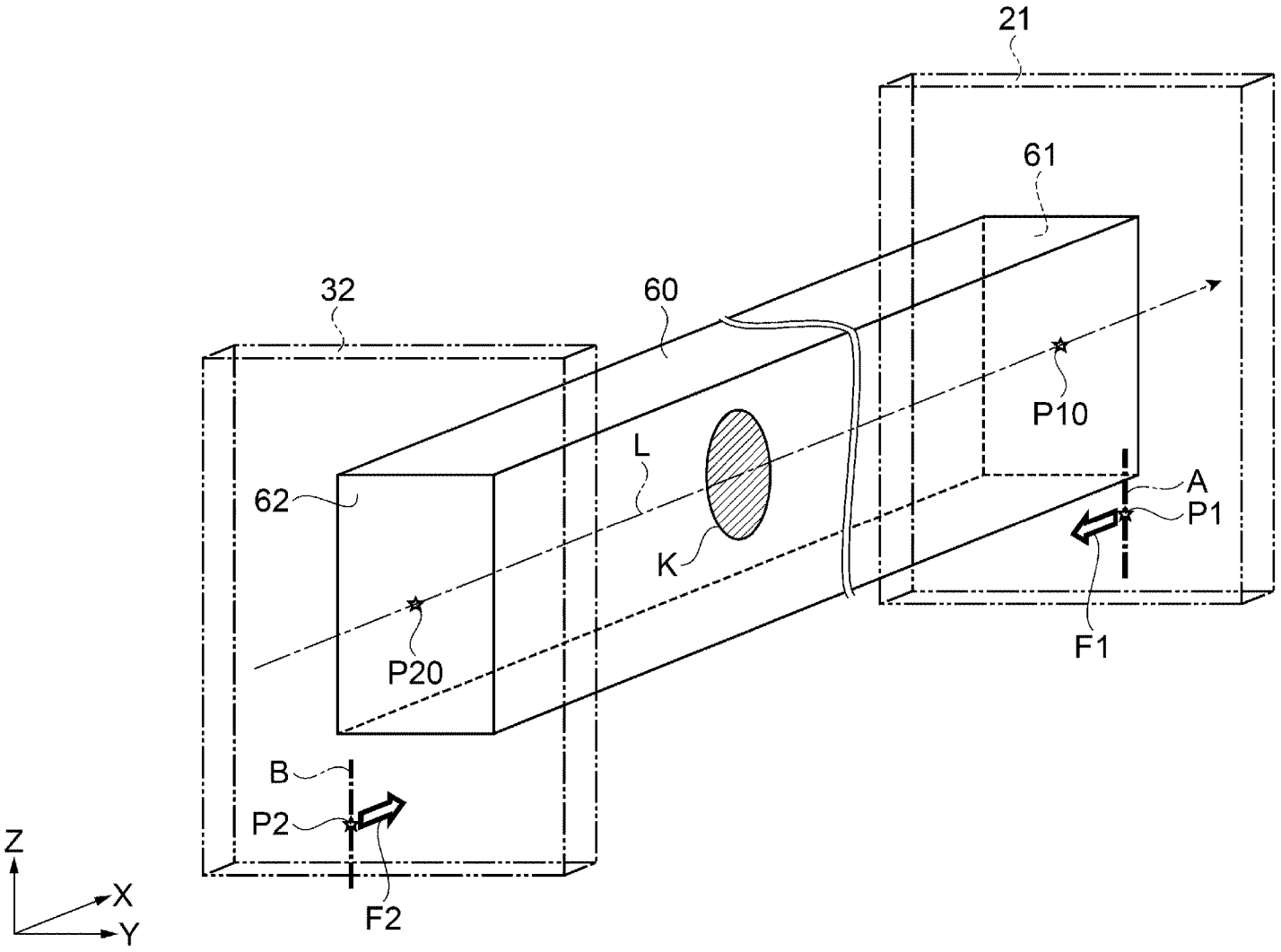
FIG. 8 is a schematic view illustrating a status of the third support member according to a comparative example.
Figure 9:
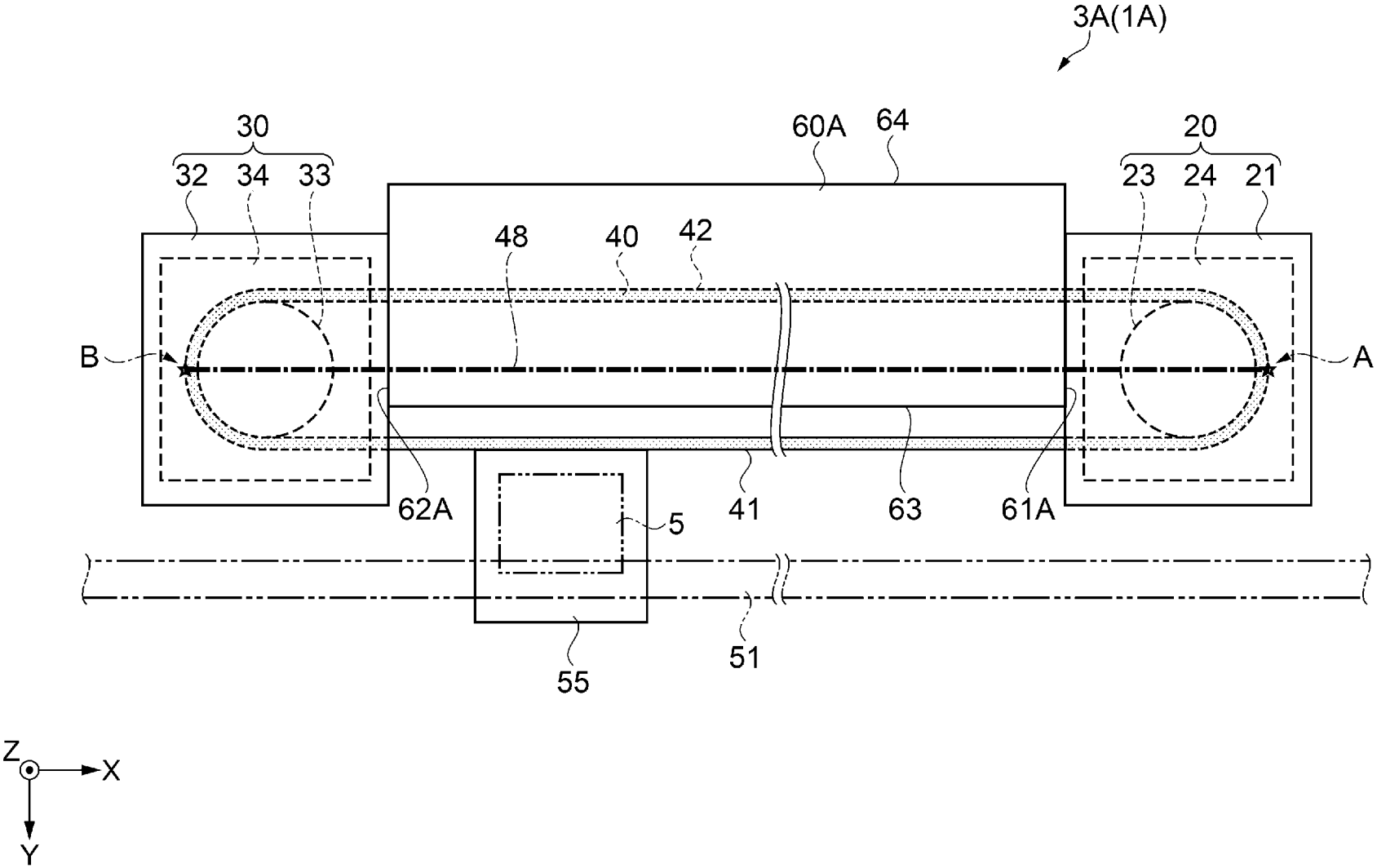
FIG. 9 is a schematic view illustrating the configuration of the carriage moving mechanism to be loaded on the printer according to Exemplary Embodiment 2.
Figure 10:
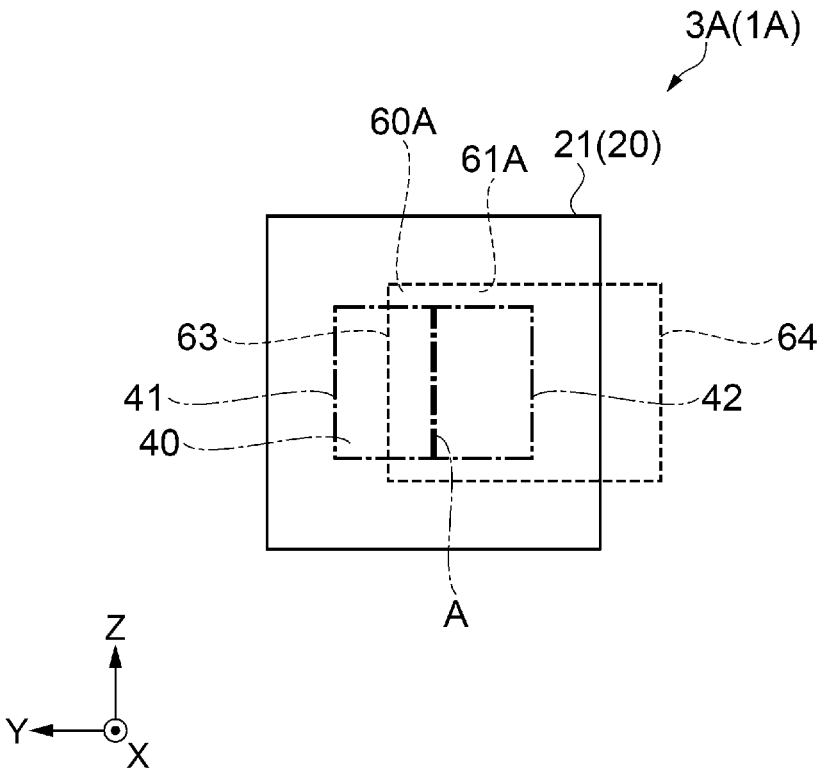
FIG. 10 is a schematic view illustrating the configuration of the carriage moving mechanism to be loaded on the printer according to Exemplary Embodiment 2.
Figure 11:
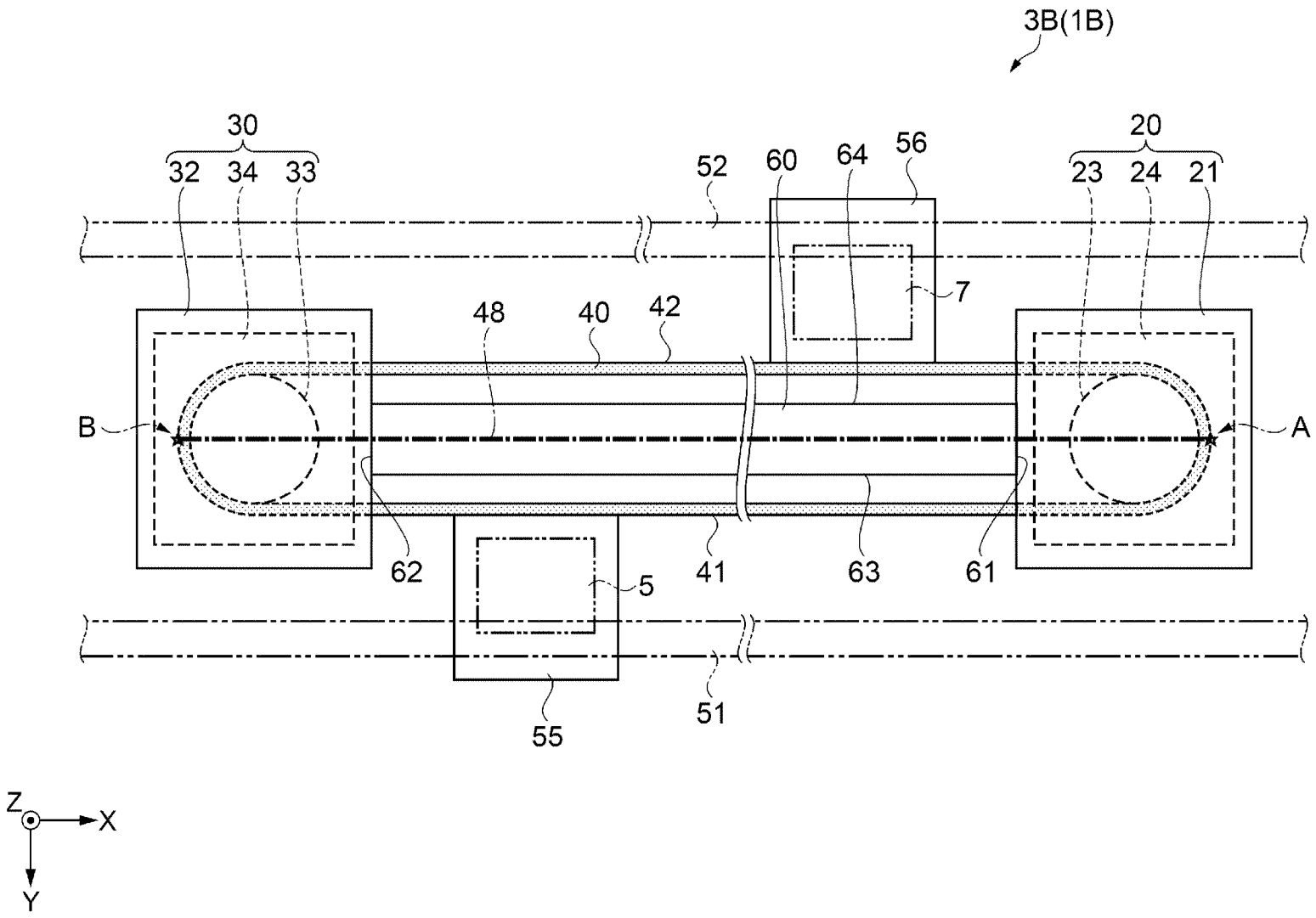
FIG. 11 is a schematic view illustrating the configuration of the carriage moving mechanism to be loaded on the printer according to Exemplary Embodiment 3.

Also note that FIG. 2, FIG. 9, and FIG. 11 illustrate the portion A and the portion B with asterisks. FIG. 3, FIG. 4, FIG. 5, FIG. 6, FIG. 7, FIG. 8, and FIG. 10 indicate the portion A and the portion B by thick chain lines. In addition, FIG. 2, FIG. 9, and FIG. 11 indicate the division plane 48 by thick chain lines.

When a predefined tension is applied to the annular belt 40, a force in the X (−) axis acts on the driving pulley 23 in an area where the annular belt 40 is in contact with the driving pulley 23, and a force in the X (+) axis acts on the driven pulley 33 in an area where the annular belt 40 is in contact with the driven pulley 33.

As illustrated in FIG. 2, the portion A is located, in a plan view from the Z axis side, at the center of the area where the annular belt 40 is in contact with the driving pulley 23. In this case, the force acting on the area where the annular belt 40 is in contact with the driving pulley 23 can be assumed to act intensely on the center (the portion A) of the area where the annular belt 40 is in contact with the driving pulley 23.

In addition, the portion B is located, in a plan view from the Z axis side, at the center of a portion where the annular belt 40 is in contact with the driven pulley 33. In this case, the force acting on the area where the annular belt 40 is in contact with the driven pulley 33 can be assumed to act intensely on the center (the portion B) of the area where the annular belt 40 is in contact with the driven pulley 33.

Thus, as illustrated in FIG. 5, when a predefined tension is applied to the annular belt 40, a force F1 in the X (−) axis can be assumed to act on the driving pulley 23 (not illustrated in FIG. 5) from the portion A of the annular belt 40, and a force F2 in the X (+) axis can be assumed to act on the driven pulley 33 (not illustrated in FIG. 5) from the portion B of the annular belt 40.

The force F1 in the X (−) axis applied to the driving pulley 23 acts on the surface 61 of the third support member 60 via the driving motor 24 and the first support member 21. Then, the portion A of the annular belt 40 serves as a point of effort to which the force F1 is applied, and the surface 61 of the third support member 60 serves as a point of action on which the force F1 acts.

The force F2 in the X (+) axis applied to the driven pulley 33 acts on the surface 62 of the third support member 60 via the base portion 34 and the second support member 32. Then, the portion B of the annular belt 40 serves as a point of effort to which the force F2 is applied, and the surface 62 of the third support member 60 serves as a point of action on which the force F2 acts.

Status of Third Support Member

Figure 6:
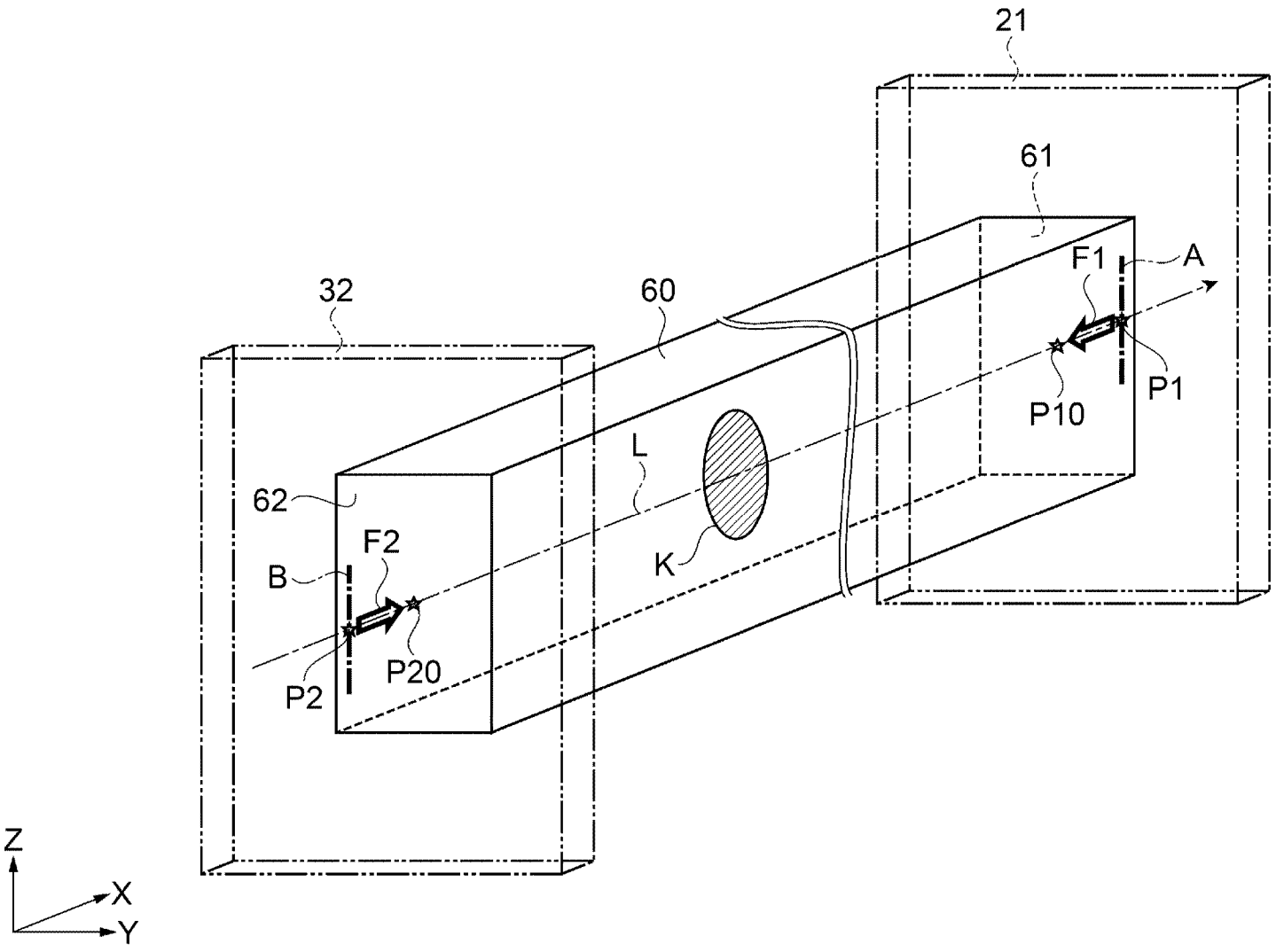
FIG. 6 is a schematic view illustrating a status of a third support member according to Exemplary Embodiment 1.

FIG. 6 is a schematic view illustrating a status of the third support member according to Exemplary Embodiment 1. FIG. 7 and FIG. 8 are schematic views illustrating a status of the third support member according to the comparative examples.

FIG. 6 to FIG. 8 indicate the third support member 60 by solid lines and schematically indicate, by two-dot chain lines, the first support member 21 and the second support member 32 as thin plate members. In addition, the portions A and B of the annular belt 40 are indicated by thick broken lines, omitting the illustration of the main body (see FIG. 5) of the annular belt 40.

As described above, the portion A of the annular belt 40 serves as the point of effort to which the force F1 is applied, the surface 61 of the third support member 60 serves as the point of action on which the force F1 acts, and the force F1 in the X (−) axis acts on the surface 61 of the third support member 60. Further, the portion B of the annular belt 40 serves as the point of effort to which the force F2 is applied, the surface 62 of the third support member 60 serves as the point of action on which the force F2 acts, and the force F2 in X (+) axis acts on the surface 62 of the third support member 60.

In the descriptions below, the point of effort to which the force F1 is applied is assumed to be located at a portion P1 that is the center of the portion A of the annular belt 40, and the portion P1 is referred to as a point of effort P1. The point of effort to which the force F2 is applied is assumed to be located at a portion P2 that is the center of the portion B of the annular belt 40, and the portion P2 is referred to as a point of effort P2. The point of action on which the force F1 acts is assumed to be located at a portion P10 on the surface 61, and the portion P10 is referred to as a point of action P10. The point of action on which the force F2 acts is assumed to be located at a portion P20 on the surface 62, and the portion P20 is referred to as a point of action P20.

The third support member 60 is fixed to the casing portion 12, where an area fixed to the casing portion 12 of the third support member 60 is referred to as a fixed area K. The fixed area K is disposed between the surface 61 and the surface 62.

The points of efforts P1 and P2, and the points of action P10 and P20 are indicated by asterisks in the drawing, and the fixed area K is indicated by an oval figure that is hatched in the drawing.

In Exemplary Embodiment 1 and the comparative examples, the positions of the portions A and B (the point of efforts P1 and P2) on which the forces F1 and F2 act differ from each other, and the other configurations are the same.

Next, actions of the forces F1 and F2 on the third support member 60 will be described below with reference to FIG. 6 to FIG. 8.

As illustrated in FIG. 6, the third support member 60 has a rectangular parallelepiped shape extending in the X axis, and the dimension in the X axis of the third support member 60 is made longer than each of the dimension in the Y axis of the third support member 60 and the dimension in the Z axis of the third support member 60. The third support member 60 is fixed to the casing portion 12 at the fixed area K.

As described above, in Exemplary Embodiment 1, in a plan view from the X axis side, the portion A is disposed to overlap with the surface 61 of the third support member 60, and the portion B is disposed to overlap (see FIG. 4) with the surface 62 of the third support member 60. In this case, the point of effort P2 at the portion B of the annular belt 40 indicated by an asterisk in the drawing, the point of action P20 on the surface 62 of the third support member 60 indicated by an asterisk in the drawing, the point of action P10 on the surface 61 of the third support member 60 indicated by an asterisk, and the point of effort P1 at the portion A of the annular belt 40 are aligned in the X axis. The fixed area K of the third support member 60 is disposed between the point of action P20 (the surface 62) and the point of action P10 (the surface 61).

FIG. 6 indicates, by a two-dot chain line, a line segment L connecting the point of effort P2, the point of action P20, the point of action P10, and the point of effort P1. The line segment L is an imaginary line extending in the X axis and has an arrow at the leading end. Note that, as illustrated in FIG. 7 and FIG. 8 as well, the line segment L (an imaginary line extending in the X axis) is depicted to facilitate the recognition of the positions of the portions A and B (the point of efforts P1 and P2) on which the forces F1 and F2 act.

As illustrated in FIG. 6, in Exemplary Embodiment 1, the point of effort P2, the point of action P20, the fixed area K, the point of action P10, and the point of effort P1 are sequentially aligned in the X axis (the line segment L). The force F1 acts on the third support member 60 in the X (−) axis, the force F2 acts on the third support member 60 in the X (+) axis, when the point of effort P2, the point of action P20, the fixed area K, the point of action P10, and the point of effort P1 are aligned in the X axis. The forces F1 and F2 conducts an action in the X (−) axis and in the X (+) axis, therefore, the forces F1 and F2 do not cause the third support member 60 to deform in the Y axis or in the Z axis. That is, a force (a moment) for deforming the third support member 60 in the Y axis or in the Z axis no longer acts on the third support member 60, when the point of effort P2, the point of action P20, the fixed area K, the point of action P10, and the point of effort P1 are aligned in the X axis.

The third support member 60 has rigidity to avoid deformation in the X axis. Thus, the force F1 in the X (−) axis and the force F2 in the X (+) axis acting on the third support member 60 hardly deform the third support member 60 in the X axis. In addition, a force (a moment) for deforming the third support member 60 in the Y axis or in the Z axis no longer acts on the third support member 60, preventing the third support member 60 from being deformed in the Y axis or in the Z axis.

Thus, the forces F1 and F2 acting on the third support member 60 hardly deform the third support member 60, retaining the shape of the third support member 60 before and after the application of the forces F1 and F2.

In the comparative example illustrated in FIG. 7 and the other comparative example illustrated in FIG. 8, in a plan view from the X axis side, the portion A is disposed to avoid overlapping with the surface 61 of the third support member 60, and the portion B is disposed to avoid overlapping with the surface 62 of the third support member 60. Thus, in the comparative example and the other comparative example, the positions of the portions A and B (point of efforts P1 and P2) on which the forces F1 and F2 act differ from those in Exemplary Embodiment 1.

As illustrated in FIG. 7, in the comparative example, the positions of the point of efforts P1 and P2 to which the forces F1 and F2 are applied are shifted to the Y (-) axis side with respect to the positions of the point of efforts P1 and P2 to which the forces F1 and F2 are applied in Exemplary Embodiment 1. Thus, the point of effort P2, the point of action P20, the fixed area K, the point of action P10, and the point of effort P1 are not aligned in this order in the X axis, but the point of efforts P1 and P2 are disposed on the Y (−) axis side with respect to the line segment L in which the point of action P20, the fixed area K, and the point of action P10 are aligned.

A force (a moment) to deform, using the fixed area K as a fulcrum, the third support member 60 in the Y (−) axis acts on the third support member 60, when the point of efforts P1 and P2 are disposed on the Y (−) axis side with respect to the line segment L (the fixed area K).

As illustrated in FIG. 8, in the other comparative example, the positions of the point of efforts P1 and P2 to which the forces F1 and F2 are applied are shifted to the Z (−) axis side with respect to the positions of the point of efforts P1 and P2 to which the forces F1 and F2 are applied in Exemplary Embodiment 1. Thus, the point of effort P2, the point of action P20, the fixed area K, the point of action P10, and the point of effort P1 are not sequentially aligned in the X axis, but the point of efforts P1 and P2 are disposed on the Z (−) axis side with respect to the line segment L in which the point of action P20, the fixed area K, and the point of action P10 are aligned.

A force (a moment) to deform, using the fixed area K as a fulcrum, the third support member 60 in the Z (−) axis acts on the third support member 60, when the point of efforts P1 and P2 are disposed on the Z (−) axis side with respect to the line segment L (the fixed area K).

As described above, the printer 1 is a large-format printer (LFP) that prints images on a single-cut sheet having a large sheet size such as A1-sized sheet of the JIS standard, a roll paper having the same width as the single-cut sheet, and the like. The printer 1 that prints on a medium M having a large size includes the recording head 5 having a large size and a heavy weight compared to a printer that prints on a medium M having a small size. Further, the recording head 5 is made to have a larger size and a heavier weight so as to increase the productivity of the printer 1.

In a case where the recording head 5 having a heavier weight bends, by its own weight, the annular belt 40 to which the recording head 5 is attached, it becomes difficult for the annular belt 40 to move stably in the X (+) axis or in the X (−) axis between the first support member 21 and the second support member 32. Thus, the recording head 5 moving together with the annular belt 40 moves unstably, quality of the image to be printed on the medium M may degrade.

Thus, the tension applied to the annular belt 40 needs to be strengthened such that the annular belt 40 does not bend by the weight of the recording head 5 when the medium M is made large in size and the recording head 5 is made heavy in weight.

In the printer that prints on a medium M having a large size, the dimension of the third support member 60 in the X axis (the distance between the driving unit 20 and the driven unit 30) is made long compared to the printer that prints on a medium M having a small size. Thus, the distance between the fixed area K (the fulcrum) and the point of actions P10 and P20 is made long, and thereby, the moment to deform the third support member 60 is made large. The printer that prints on a medium M having a large size needs to strengthen the tension applied to the annular belt 40 compared to the printer that prints on a medium M having a small size, and thereby, the moment to deform the third support member 60 is further made large.

The third support member 60 having rigidity, when the moment to deform the third support member 60 is small, is suppressed from being deformed, maintaining the positions of the pulleys 23 and 33, and a deformation (e.g., a deflection) of the annular belt 40 hardly occurs.

In the carriage moving mechanism according to the comparative examples, however, the moment to deform the third support member 60 is further made large, thus, the third support member 60 is readily deformed and the positions of the pulleys 23 and 33 change. Thus, the annular belt 40 readily undergoes a deformation (e.g., a deflection). When the third support member 60 is made to deform, the positions of the pulleys 23 and 33 change, the annular belt 40 undergoes a deformation (e.g., a deflection), and the annular belt 40 move unstably. Thus, in the printer having the carriage moving mechanism according to the comparative examples, the annular belt 40 and the recording head 5 move unstably, quality of the image to be printed on the medium M may degrade.

In the carriage moving mechanism 3 according to Exemplary Embodiment 1, even when the forces F1 and F2 act on the third support member 60, the moment to deform the third support member 60 does not work, therefore, the deformation (e.g., deflection) of the annular belt 40 hardly occurs, and the annular belt 40 can be stably and properly moved. Thus, in the printer 1 having the carriage moving mechanism 3 according to Exemplary Embodiment 1, the annular belt 40 and the recording head 5 are stably and properly moved, enabling high-quality images to be printed on the medium M.

In the carriage moving mechanism 3 according to Exemplary Embodiment 1, since the moment to deform the third support member 60 does not work, the third support member 60 is suppressed from being deformed, even when the third support member 60 in the X axis (the distance between the first support member 21 and the second support member 32) is made large in length. Thus, even when the carriage moving mechanism 3 according to Exemplary Embodiment 1 is applied to a printer capable of printing on a medium larger than a single-cut sheet having a large sheet size such as A1-sized sheet of the JIS standard, the annular belt 40 of the printer is prevented from undergoing a deformation (e.g., a deflection) and thereby, the annular belt 40 and the recording head 5 are stably and properly moved, enabling high-quality images to be printed on the medium M.

That is, the carriage moving mechanism 3 according to Exemplary Embodiment 1 is suitably used, in addition to a printer 1 capable of printing on a single-cut sheet having a large sheet size such as A1-sized sheet of the JIS standard, for a printer that is larger than the printer 1.

Exemplary Embodiment 2

FIG. 9 and FIG. 10 are schematic views illustrating a configuration of the carriage moving mechanism to be loaded on the printer according to Exemplary Embodiment 2.

More specifically, FIG. 9, which is a view corresponding to FIG. 2, is a plan view of a carriage moving mechanism 3A from the Z axis side. FIG. 10, which is a view corresponding to FIG. 4, is a plan view of the carriage moving mechanism 3A from the X axis side.

The carriage moving mechanism 3 to be loaded on the printer 1 according to Exemplary Embodiment 1 has the same configuration, except for the shape of the third support member, as the carriage moving mechanism 3A to be loaded on a printer 1A according to Exemplary Embodiment 2. That is, a third support member 60A according to Exemplary Embodiment 2 has a longer dimension in the Y axis than the third support member 60 according to Exemplary Embodiment 1. This is the main difference between Exemplary Embodiment 2 and Exemplary Embodiment 1.

Hereinafter, an overview of the printer 1A according to Exemplary Embodiment 2 is described with reference to FIG. 9 and FIG. 10, focusing on the differences from Exemplary Embodiment 1. Here, the components that are the same as the components in Exemplary Embodiment 1 are referenced using like numbers, and no descriptions for such components are provided below.

As illustrated in FIG. 9, the carriage moving mechanism 3A has a driving unit 20 disposed on the X (+) axis side, the driven unit 30 disposed on the X (−) axis side, the third support member 60A for supporting the driving unit 20 and the driven unit 30, the annular belt 40 wound around the driving pulley 23 of the driving unit 20 and the driven pulley 33 of the driven unit 30, and a carriage 55 attached to the annular belt 40.

As illustrated in FIG. 9, the third support member 60A is disposed between the first support member 21 and the second support member 32 and is fixed to the casing portion 12. The third support member 60A has a surface 61A disposed on the X (+) axis side, a surface 62A disposed on the X (−) axis side, a surface 63 disposed on the Y (+) axis side, and a surface 64 disposed on the Y (−) axis side. The surface 61A of the third support member 60A is in contact with the first support member 21. The surface 62A of the third support member 60A is in contact with the second support member 32.

The surfaces 61A and 62A of the third support member 60A are made wider toward the Y (−) axis side than the surfaces 61 and 62 of the third support member 60 according to Exemplary Embodiment 1. The surfaces 63 and 64 of the third support member 60A have the same size (the same shape) as the surfaces 63 and 64 of the third support member 60 according to Exemplary Embodiment 1.

The surfaces 61A and 62A of the third support member 60A is made wide toward the Y (−) axis side, thus, the surface 64 on the Y (−) axis side of the third support member 60A is disposed on the Y (−) axis side with respect to the second outer peripheral surface 42 of the annular belt 40, which is the outside of the annular belt 40. Thus, in a plan view from the Z axis side, the surface 64 of the third support member 60A is not disposed between the first outer peripheral surface 41 of the annular belt 40 and the second outer peripheral surface 42 of the annular belt 40.

In Exemplary Embodiment 2, although the surface 63 of the third support member 60A is disposed between the first outer peripheral surface 41 of the annular belt 40 and the second outer peripheral surface 42 of the annular belt 40, and the surfaces 61A and 62A of the third support member 60A are disposed between the end on the X (+) axis side (the portion A) of the annular belt 40 and the end on the X (−) axis side (the portion B) of the annular belt 40, the surface 64 of the third support member 60A is not disposed between the first outer peripheral surface 41 of the annular belt 40 and the second outer peripheral surface 42 of the annular belt 40, which fails to meet the configuration in the present application that the "third support member is disposed inside the annular belt".

As illustrated in FIG. 10, the end on the X (+) axis side (the portion A) of the annular belt 40 is disposed to overlap, in a plan view from the X axis side, with the surface 61A of the third support member 60A. Although not illustrated in FIG. 10, the end on the X (−) axis side (the portion B) of the annular belt 40 is disposed to overlap, in a plan view from the X axis side, with the surface 62A of the third support member 60A in the same manner as the end on the X (+) axis side (the portion A) of the annular belt 40.

The status that the "in a plan view from the first axis side, a portion where the annular belt intersects with the division plane overlaps with the third support member" includes as an example the status that, in a plan view from the X axis side, the end on the X (+) axis side (the portion A) of the annular belt 40 is disposed to overlap with the surface 61A of the third support member 60A, and the end on the X (−) axis side (the portion B; see FIG. 3) of the annular belt 40 is disposed to overlap with the surface 62A of the third support member 60A.

Thus, Exemplary Embodiment 2 satisfies the configuration in the present application that the "portion where the annular belt intersects with the division plane overlaps, in a plan view from the first axis side, with the third support member".

The portion A is disposed to overlap with the surface 61A of the third support member 60A, and the portion B is disposed to overlap with the surface 62A of the third support member 60A, in a plan view from the X axis side, when there is the configuration in the present application that the "portion where the annular belt intersects the division plane overlaps, in a plan view from the first axis side, with the third support member". Then, the point of effort P2, the point of action P20, the fixed area K, the point of action P10, and the point of effort P1 can be aligned in the X axis.

The force F1 in the X (−) axis and the force F2 in the X (+) axis act on the third support member 60, and a force (a moment) for deforming the third support member 60 in the Y axis or in the Z axis no longer acts on the third support member 60, when the point of effort P2, the point of action P20, the fixed area K, the point of action P10, and the point of effort P1 are aligned in the X axis.

The third support member 60 has rigidity to avoid deformation in the X axis. In addition, a force (a moment) for deforming the third support member 60 in the Y axis or in the Z axis no longer acts on the third support member 60, the third support member 60 is hardly deformed in the Y axis or in the Z axis.

Thus, the same effects as in Exemplary Embodiment 1 can be obtained such that the forces F1 and F2 acting on the third support member 60 hardly deform the third support member 60, retaining the shape of the third support member 60 before and after the application of the forces F1 and F2.

Then, the carriage moving mechanism 3A according to Exemplary Embodiment 2 is suitably used, in addition to the printer 1A, for a printer that is larger than the printer 1A capable of printing on a single-cut sheet having a large sheet size such as A1-sized sheet of the JIS standard.

Exemplary Embodiment 3

FIG. 11, which is a view corresponding to FIG. 2, is a schematic view illustrating a configuration of the carriage moving mechanism to be loaded on the printer according to Exemplary Embodiment 3.

A carriage moving mechanism 3B to be loaded on a printer 1B according to Exemplary Embodiment 3 includes two carriages 55 and 56. The carriage moving mechanism 3 to be loaded on the printer 1 according to Exemplary Embodiment 1 includes one carriage 55. This is the main difference between Exemplary Embodiment 3 and Exemplary Embodiment 1.

Hereinafter, an overview of the printer 1B according to Exemplary Embodiment 3 is described with reference to FIG. 11, focusing on the differences from Exemplary Embodiment 1. Here, the components that are the same as the components in Exemplary Embodiment 1 are referenced using like numbers, and no descriptions for such components are provided below.

As illustrated in FIG. 11, the carriage 55, as an example of the "first carriage" is attached to the first outer peripheral surface 41 of the annular belt 40, and the carriage 56 as an example of the "second carriage" is attached to the second outer peripheral surface 42 of the annular belt 40. The recording head 5 as an example of the "first liquid discharge head" is attached to the surface on the Z (−) axis side of the carriage 55. A recording head 7 discharging an ink as an example of the "second liquid discharge head" is attached to the surface on the Z (−) axis side of the carriage 56.

In the printer 1B according to Exemplary Embodiment 3, since the medium M is transported in the Y axis, the carriage 56 is disposed on the upstream side in the transportation axis of the medium M and the carriage 55 is disposed on the downstream side in the transportation axis of the medium M. Further, the recording head 7 attached to the carriage 56 is disposed on the upstream side in the transportation axis of the medium M and the recording head 5 attached to the carriage 55 is disposed on the downstream side in the transportation axis of the medium M.

Then, the recording head 5 and the recording head 7 discharge an ink as an example of the "first liquid".

The carriage 55 is supported by the guide shaft 51. The carriage 55 moves in the X (+) axis or in the X (−) axis between the first support member 21 and the second support member 32, with the movement axis of the carriage 55 guided by the guide shaft 51.

The carriage 56 is supported by a guide shaft 52. The guide shaft 52 is supported, extending in the X axis, by the casing portion 12 (see FIG. 1). The guide shaft 52 is a member for guiding the movement of the carriage 56. That is, the carriage 56 moves in the X (+) axis or in the X (−) axis between the first support member 21 and the second support member 32, with the movement axis of the carriage 56 controlled by the guide shaft 52.

When the center of a line segment connecting the carriage 55 and the carriage 56 is defined as a symmetrical point, the carriage 56 is disposed to be point-symmetry with respect to the carriage 55. When the driving motor 24 is driven to rotate the driving pulley 23, the annular belt 40 rotates following the rotation of the driving pulley 23, and the carriage 55 and the carriage 56 attached to the annular belt 40 are respectively moved in opposite axis. Then, the recording head 5 attached to the carriage 55 and the recording head 7 attached to the carriage 56 are respectively moved in opposite axes.

For example, when the carriage 55 and the recording head 5 are moved in the X (+) axis, the carriage 56 and the recording head 7 are moved in the X (−) axis. When the carriage 55 and the recording head 5 are moved in the X (-) axis, the carriage 56 and the recording head 7 are moved in the X (+) axis.

According to the configuration, the printer 1B repeats an operation of moving the recording head 5 in the X (+) axis or in the X (−) axis while the recording head 5 is discharging an ink onto the medium M and moving the recording head 7 in the X (+) axis or in the X (−) axis while the recording head 7 is discharging an ink onto the medium M, and an operation of transporting the medium M in the Y axis, and thus a desired image is printed on the medium M.

In the descriptions below, an operation in which the recording heads 5 and 7 are moved in the X (+) axis or in the X (−) axis while discharging an ink is referred to as a main scanning movement.

In the printer 1B according to Exemplary Embodiment 3, both the recording head 5 and the recording head 7 discharge an ink in a single main scanning movement, while in the printer 1 according to Exemplary Embodiment 1, only the recording head 5 discharges an ink in a single main scanning movement.

Thus, in the printer 1B according to Exemplary Embodiment 3, an area where an ink is discharged in a single main scanning movement is twice as large as the area in the printer 1 according to Exemplary Embodiment 1. As a result, the printer 1B according to Exemplary Embodiment 3 can improve productivity, printing an image on the medium M faster than the printer 1 according to Exemplary Embodiment 1.

The invention is not limited to the above-described exemplary embodiments, but can be appropriately changed within a scope not contrary to the gist or idea of the invention which can be read from the claims and the entire specification, and a variety of modifications other than the above can be conceivable. Hereinafter, modification examples are described.

Modification Example 1

In the printer according to Modification Example 1, the recording head 5 discharges a colorless ink, and the recording head 7 discharges a color ink. Since the medium M is transported in the Y axis, the recording head 7 is disposed on the upstream side in the transportation axis of the medium M and the recording head 5 is disposed on the downstream side in the transportation axis of the medium M. Thus, in the printer according to Modification Example 1, the recording head 7 discharges a color ink and then the recording head 5 discharges a colorless ink, onto the medium M.

Note that the recording head 5 is an example of the "first liquid discharge head". The colorless ink discharged from the recording head 5, which is an example of the "first liquid", is a colorless ink capable of suppressing scattered reflection of light, such as an overcoat ink (e.g., a gloss optimizer) or a varnish. The recording head 7 is an example of the "second liquid discharge head". The color ink discharged from the recording head 7, which is an example of the "second liquid", contains pigments or dyes such as cyan (C), magenta (M), yellow (Y), and black (K).

For example, the color ink, which is a pigment-based ink, has high degree of gloss (the proportion of incoming light at a fixed angle that is reflected at the same diagonal) and thus differences in the degree of gloss occur when areas of high and low dot density are mixed in the same printed image, and this may cause unevenness in gloss and an unnatural feeling to the image. The unevenness in gloss is reduced in such a way that a colorless ink (a gloss optimizer) not containing coloring materials is discharged onto the area where dots are formed by a color ink, and then the colorless ink is driven into portions having low dot density of the dots formed by the color ink.

For example, a colorless ink (a varnish) not containing coloring materials is discharged onto the area where dots are formed by a color ink to cover the dots formed by the color ink with the colorless ink, thereby enhancing the irregularities of the dots formed by the color ink to provide a stereoscopic effect with the image formed with the color ink.

Modification Example 2

In the printer according to Modification Example 2, the recording head 5 discharges a color ink, and the recording head 7 discharges a primer (an undercoat agent). Since the medium M is transported in the Y axis, the recording head 7 that discharges a primer (an undercoat agent) is disposed on the upstream side in the transportation axis of the medium M and the recording head 5 that discharges a color ink is disposed on the downstream side in the transportation axis of the medium M. Thus, in the printer according to Modification Example 2, the recording head 5 discharges a color ink onto the medium M coated by a primer (an undercoat agent) discharged by the recording head 7.

Note that the recording head 5 is an example of the "first liquid discharge head". The color ink discharged from the recording head 5 is an example of the "first liquid". The recording head 7 is an example of the "second liquid discharge head". The primer (the undercoat agent) discharged from the recording head 7 is an example of the "second liquid".

The fixability (the adhesion) of the color ink onto the medium M is enhanced is such a way that, for example, the recording head 7 discharges a primer (an undercoat agent) onto the medium M and then the recording head 5 discharges a color ink onto the medium M.

Modification Example 3

In the printer according to Modification Example 3, the recording head 5 that discharges an ink is attached to the carriage 55, and an ionizer that removes static electricity charged on the medium M is attached to the carriage 56. Since the medium M is transported in the Y axis, the ionizer is disposed on the upstream side in the transportation axis of the medium M, and the recording head 5 is disposed on the downstream side in the transportation axis of the medium M, thus, the recording head 5 discharges an ink onto the medium M that has been neutralized by the ionizer.

Note that the carriage 55 to which the recording head 5 is attached is an example of the "first carriage". The recording head 5 attached to the carriage 55 is an example of the "first liquid discharge head". The carriage 56 to which the ionizer is attached is an example of the "second carriage".

The ionizer has, for example, a discharging portion and an air supply portion. An AC voltage is supplied to the discharging portion, generating an air ionized into positive ions or negative ions by corona discharge. The air supply portion supplies the ionized air onto the medium M, neutralizing the static electricity charged on the medium M.

For example, the ionizer includes an electromagnetic-wave radiating portion that radiates electromagnetic waves such as soft X-rays and ultraviolet rays. The air around the medium M is ionized by soft X-rays or ultraviolet rays radiated from the electromagnetic-wave radiating portion to eliminate the static electricity charged on the medium M.

This configuration allows, first of all, the ionizer to eliminate the static electricity charged on the medium M and enables the recording head 5 to discharge an ink onto the medium M from which the static electricity has been eliminated.

For example, the medium M formed with a film that is composed of a vinyl chloride resin, an acrylic resin, and the like is more readily charged than paper composed of cellulose fibers. When the medium M is electrostatically charged and the ink discharged from the recording head 5 is charged with static electricity as well, the adhesion position of the ink discharged from the recording head 5 is disturbed by the static electricity and quality of the image to be printed on the medium M may degrade.

When the static electricity charged on the medium M is neutralized by the ionizer, even in a case that an ink discharged from the recording head 5 is charged with static electricity, an adverse effect of static electricity, that is, a disturbance of the adhesion position of the ink discharged from the recording head 5 is suppressed, and thus, the quality of the image formed on the medium M is enhanced.

Modification Example 4

In the printer according to Modification Example 4, an irradiation device that irradiates light (e.g., ultraviolet light) is attached to the carriage 55, and the recording head 7 that discharges a photocurable ink is attached to the carriage 56. Since the medium M is transported in the Y axis, the recording head 7 that discharges the photocurable ink is disposed on the upstream side in the transportation axis of the medium M and an irradiation device that irradiates light is disposed on the downstream side in the transportation axis of the medium M, thus, the irradiation device irradiates light to the medium M onto which the recording head 7 has discharged an ink.

Note that the carriage 56 to which the recording head 7 is attached is an example of the "first carriage". The carriage 55 to which an irradiation device is attached is an example of the "second carriage".

In Modification Example 4, the photocurable ink discharged from the recording head 7 onto the medium M is promptly cured by the irradiation device, eliminating the inconvenience of the ink discharged onto the medium M spreading and bleeding.

Modification Example 5

In the above-described embodiments, the driving unit 20 includes the driving pulley 23, the driving motor 24, and the first support member 21, where the driving pulley 23 and the driving motor 24 are disposed inside the first support member 21.

In Modification Example 5, the driving unit 20 includes the driving pulley 23, a transmission, the driving motor 24, and the first support member 21, where the driving pulley 23 and the transmission are disposed inside the first support member 21, and the driving motor 24 is disposed outside the first support member 21.

The transmission, which is disposed between the driving pulley 23 and the driving motor 24, controls a rotation speed of the driving pulley 23. That is, the driving unit 20 may be configured to control the rotation speed of the driving pulley 23 by the transmission provided thereinside.

Modification Example 6

In the above-described embodiments, the guide shafts 51 and 52, which are supported by the casing portion 12, are excluded from the components of the carriage moving mechanisms 3, 3A, and 3B. The support members 21 and 32 may support the guide shafts 51 and 52 that are included in the components of the carriage moving mechanisms 3, 3A, and 3B.

This application claims priority under 35 U.S.C. § 119 to Japanese Patent Application No. 2017-228723, filed Nov. 29, 2017. The entire disclosure of Japanese Patent Application No. 2017-228723 is hereby incorporated herein by reference.

What is claimed is:

1. A carriage moving mechanism comprising:

a driving unit including a driving pulley, a driving motor, and a first support member for supporting the driving pulley and the driving motor;

a driven unit including a driven pulley and a second support member for supporting the driven pulley;

a third support member that is disposed from the first support member to the second support member, and supports the driving unit and the driven unit;

an annular belt that is wound around the driving pulley and the driven pulley, and has, between the driving pulley and the driven pulley, a first outer peripheral surface and a second outer peripheral surface; and a first carriage that is attached to the first outer peripheral surface, wherein the second support member, the third support member, and the first support member are aligned in this order in a first axis, with a portion of a casing mounting area of the third support member being aligned in the first axis, the second outer peripheral surface and the first outer peripheral surface are aligned in a second axis intersecting with the first axis a vertical direction, the third support member is disposed inside the annular belt and the first outer peripheral surface, the third support member, and the second outer peripheral surface are aligned in this order in the second axis.

2. The carriage moving mechanism according to claim 1, wherein a second carriage is attached to the second outer peripheral surface.

3. A liquid discharge apparatus comprising:

the carriage moving mechanism according to claim 1; and a first liquid discharge head that is attached to the first carriage and discharges a first liquid onto a medium.

4. A liquid discharge apparatus comprising:

the carriage moving mechanism according to claim 1;

a first liquid discharge head that is attached to the first carriage and discharges a first liquid onto a medium; and a second liquid discharge head that is attached to a second carriage, and discharges the first liquid or a second liquid onto the medium.

5. A liquid discharge apparatus comprising:

the carriage moving mechanism according to claim 1;

a liquid discharge head that is attached to the first carriage, and discharges a first liquid onto a medium; and an irradiation device irradiating the medium with light, or an ionizer neutralizing the medium, that is attached to a second carriage.

6. A carriage moving mechanism comprising:

a driving unit including a driving pulley, a driving motor, and a first support member for supporting the driving pulley and the driving motor;

a driven unit including a driven pulley and a second support member for supporting the driven pulley;

a third support member that is disposed from the first support member to the second support member, and supports the driving unit and the driven unit;

an annular belt that is wound around the driving pulley and the driven pulley, and has, between the driving pulley and the driven pulley, a first outer peripheral surface and a second outer peripheral surface facing to the first outer peripheral surface; and a first carriage that is attached to the first outer peripheral surface, wherein when a division plane is defined as a plane to equally divide the annular belt and when the division plane faces to the first outer peripheral surface and the second outer peripheral surface, the second support member, the third support member, and the first support member are aligned in this order in a first axis, with a portion of a casing mounting area of the third support member being aligned in the first axis, the second outer peripheral surface and the first outer peripheral surface are aligned in the second axis intersecting with the first axis, and in a plan view from the first axis, a portion where the annular belt intersects with the division plane overlaps with the third support member.

7. The carriage moving mechanism according to claim 6, wherein a second carriage is attached to the second outer peripheral surface.

8. A liquid discharge apparatus comprising:

the carriage moving mechanism according to claim 6; and a first liquid discharge head that is attached to the first carriage and discharges a first liquid onto a medium.

9. A liquid discharge apparatus comprising:

the carriage moving mechanism according to claim 6;

a first liquid discharge head that is attached to the first carriage and discharges a first liquid onto a medium; and a second liquid discharge head that is attached to a second carriage, and discharges the first liquid or a second liquid onto the medium.

10. A liquid discharge apparatus comprising:

the carriage moving mechanism according to claim 6;

a liquid discharge head that is attached to the first carriage, and discharges a first liquid onto a medium; and an irradiation device irradiating the medium with light, or an ionizer neutralizing the medium, that is attached to a second carriage.

* * * * *